US008334772B2

(12) United States Patent
Triggiani

(10) Patent No.: US 8,334,772 B2
(45) Date of Patent: Dec. 18, 2012

(54) PERSONAL ARTIFACT TETHERING DEVICE

(76) Inventor: Ellen B. Triggiani, Naples, FL (US)

( * ) Notice: Subject to any disclaimer, the term of this patent is extended or adjusted under 35 U.S.C. 154(b) by 440 days.

(21) Appl. No.: 12/640,247

(22) Filed: Dec. 17, 2009

(65) Prior Publication Data

US 2011/0146857 A1 Jun. 23, 2011

(51) Int. Cl.
*G08B 13/14* (2006.01)

(52) U.S. Cl. ..... 340/568.1; 340/568.7; 340/815.4; 340/693.5

(58) Field of Classification Search ..... None
See application file for complete search history.

(56) References Cited

U.S. PATENT DOCUMENTS

| | | | | |
|---|---|---|---|---|
| 3,815,118 | A | 6/1974 | McDonald | |
| 3,851,326 | A | 11/1974 | Costa | |
| 4,080,595 | A | 3/1978 | Rosen | |
| 6,140,923 | A | 10/2000 | Lam | |
| 7,217,191 | B2 * | 5/2007 | Cordell | 463/37 |
| 2001/0038330 | A1 * | 11/2001 | Garcia | 340/568.1 |
| 2007/0158158 | A1 * | 7/2007 | Ameche | 190/108 |
| 2008/0072844 | A1 * | 3/2008 | Konigsberg | 119/770 |
| 2011/0199210 | A1 * | 8/2011 | McLean | 340/568.1 |

* cited by examiner

*Primary Examiner* — Jennifer Mehmood
*Assistant Examiner* — Brian Wilson
(74) *Attorney, Agent, or Firm* — Dale J. Ream

(57) ABSTRACT

A personal artifact tethering device includes a casing having an open wrist-receiving area for allowing the casing to be worn as a bracelet on a person's wrist, the casing having an enclosed interior area. A reel is positioned inside the enclosed interior area and is movable between retracted and extended configurations. A spring connects the spring and casing and biases the reel to the retracted configuration. The tethering device includes a flexible tether having a first end coupled to the reel and a second end coupled to a hook, the tether passing through the enclosed interior area of the casing such that at least a portion of the hook is always outside the enclosed interior area, relatively less of the flexible tether being outside the enclosed interior area of the casing when the reel is at the retracted configuration.

10 Claims, 6 Drawing Sheets

PERSONAL ARTIFACT TETHERING DEVICE

BACKGROUND OF THE INVENTION

This invention relates generally to security devices and, more particularly, to a personal artifact tethering device that enables a user to tether a personal item to her wrist and that provides sensory, audible, and visual alerts if the personal item is separated from the user.

A purse carried by a woman is often a desirable target for theft in that it may be easy to grab away from a relatively defenseless woman that can do little to thwart the attack. Further, a woman whose purse has been stolen may be unable to draw the attention of other people to the purse snatching, especially if injured or shaken up by the attack. In addition, if the purse has been set down or in a busy environment, the woman may not even be aware that the purse has been stolen. It is understood that the circumstance of a purse theft is just an example and many other items may similarly be subject to theft or loss and be in need of heightened security.

Various devices have been proposed for securing personal items and for alerting a user and others nearby when such an item has been stolen or separated from the intended owner. Although assumably effective for their intended purposes, the existing devices do not enable an item to be tethered to a person's wrist or to provide sensory, audible, and visual alarms directly in a wrist based housing.

Therefore, it would be desirable to have a personal artifact tethering device that enables a user to tether a personal item to her wrist so as to keep track of its whereabouts and to prevent theft. Further, it would be desirable to have a personal artifact tethering device that enables the artifact to be extended a predetermined distance from the user and which automatically provides audible, visual, and sensory alerts if the item is separated from the user's wrist.

SUMMARY OF THE INVENTION

A personal artifact tethering device according to the present invention includes a casing having an open wrist-receiving area for allowing the casing to be worn as a bracelet on a person's wrist, the casing having an enclosed interior area. A reel is positioned inside the enclosed interior area and is movable between retracted and extended configurations. A spring connects the spring and casing and biases the reel to the retracted configuration. The tethering device includes a flexible tether having a first end coupled to the reel and a second end coupled to a hook, the tether passing through the enclosed interior area of the casing such that at least a portion of the hook is always outside the enclosed interior area, relatively less of the flexible tether being outside the enclosed interior area of the casing when the reel is at the retracted configuration.

Therefore, a general object of this invention is to provide a personal artifact tethering device that enables a user to remain physically coupled to a desired personal item.

Another object of this invention is to provide a personal artifact tethering device, as aforesaid, having a bracelet style casing that may be removably worn on a user's wrist and a tether that may be coupled to the personal artifact.

Still another object of this invention is to provide a personal artifact tethering device, as aforesaid, having a spring loaded reel that allows a tethered item to be extended from the casing a predetermined distance while biasing it toward a retracted position.

Yet another object of this invention is to provide a personal artifact tethering device, as aforesaid, that includes audible, visual, and/or sensory alarms that are activated if the tether is severed.

A further object of this invention is to provide a personal artifact tethering device, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
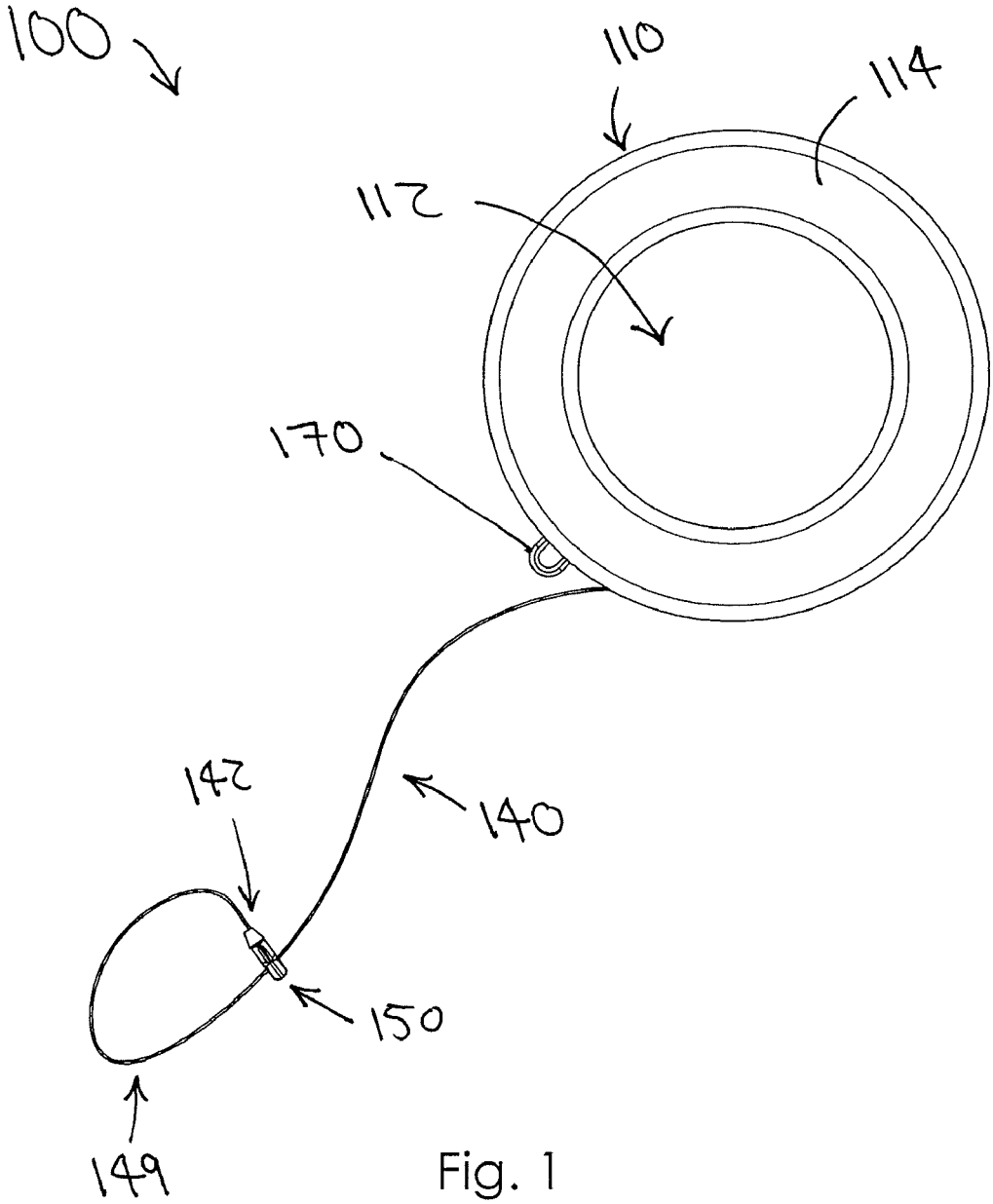
FIG. 1 is a side view of a personal artifact tethering device according to a preferred embodiment of the present invention.

Personal artifact tethering devices according to the present invention will now be described in detail with reference to FIGS. 1 through 6 of the accompanying drawings. More particularly, a personal artifact tethering device 100 according to one embodiment includes a casing 110, a reel 120, a spring 130, a flexible tether 140, and a hook 150.

As shown in FIG. 1, the casing 110 has an open wrist-receiving area 112 for allowing the casing 110 to be worn as a bracelet on a person's wrist. The casing 110 also has an enclosed interior area defined by (i.e., inside) wall 114. The casing 110 may have an annular configuration, as shown in the drawings, and may be constructed of any durable material, such as metal and plastic. It may be desirable for the casing 110 to include ornamentation, though not explicitly shown in the drawings.

The reel 120 (FIG. 4) is inside the enclosed interior area of the casing (i.e., inside the wall 114), and is movable (e.g., rotatable) between retracted and extended configurations. The spring 130 (FIG. 4) is in communication with the reel 120 and the casing 110 to bias the reel 120 to the retracted configuration.

The flexible tether 140 has a first end (not shown) coupled to the reel 120 and a second end 142 coupled to the hook 150. The hook 150 may have an inner area 152 complementary to the tether 140 to allow the tether 140 to selectively pass through the inner area 152 to form a closed loop 149 (FIG. 3) that consists of a portion of the tether 140 and the hook 150.

The tether 140 passes through the enclosed interior area of the casing 110 (i.e., through the wall 114 at opening 116, shown in FIG. 2) such that at least a portion of the hook 150 is always outside the enclosed interior area of the casing 110. Relatively more of the flexible tether 140 is outside the enclosed interior area of said casing 110 when the reel 120 is at said extended configuration, while relatively less of the flexible tether 140 is outside the enclosed interior area of the casing 110 when the reel 120 is at the retracted configuration.

Figure 4:
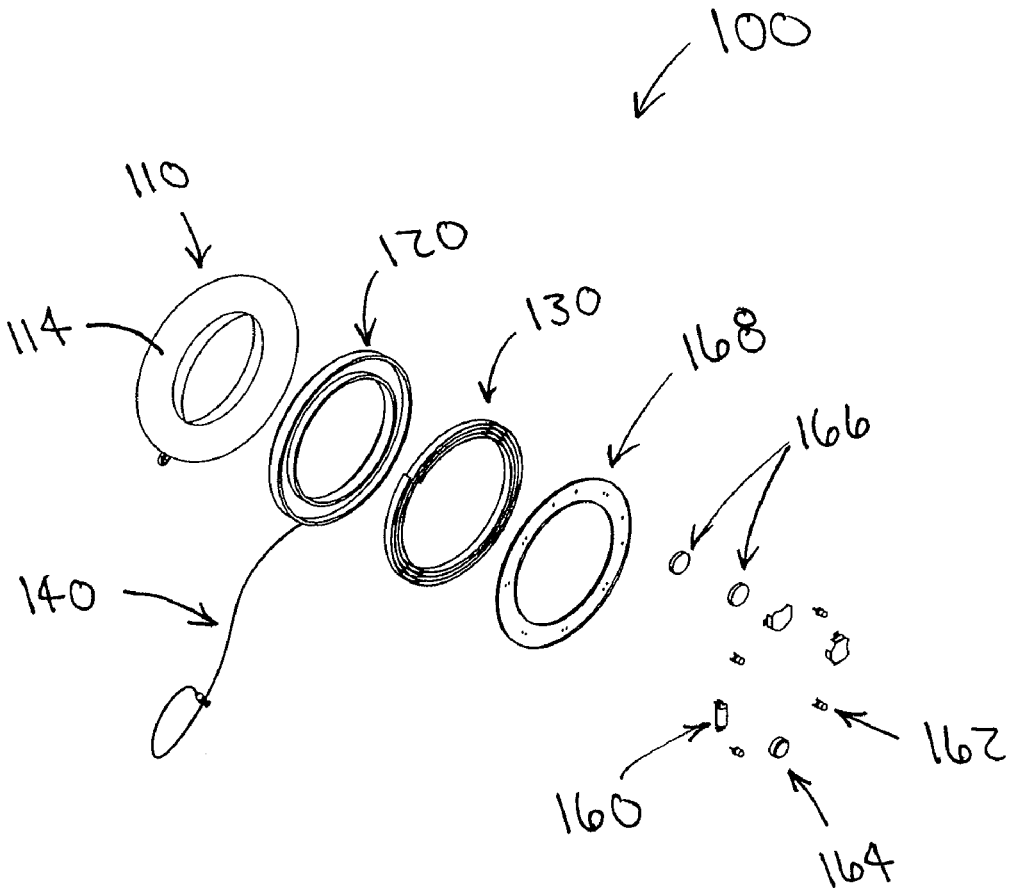
FIG. 4 is an exploded view of the tethering device as in FIG. 3.

As shown in FIG. 4, a vibrating element 160, a light 162, and/or a siren 164 may be operatively coupled to the casing 110, and at least one battery 166 may power the vibrating element 160, the light 162, and the siren 164. A circuit board 168 (FIG. 4) may be inside the enclosed interior area of the casing 110, and means for detecting a severing of the tether 140 may also be included. For example, wiring (not shown) may extend from the circuit board 168 through the tether 140 to create a closed electrical loop, and circuitry may detect any breach of the closed electrical loop. In addition, circuitry may actuate the vibrating element 160, the light 162, and/or the siren 164 upon detection of a breach of the closed electrical loop.

Figure 6:
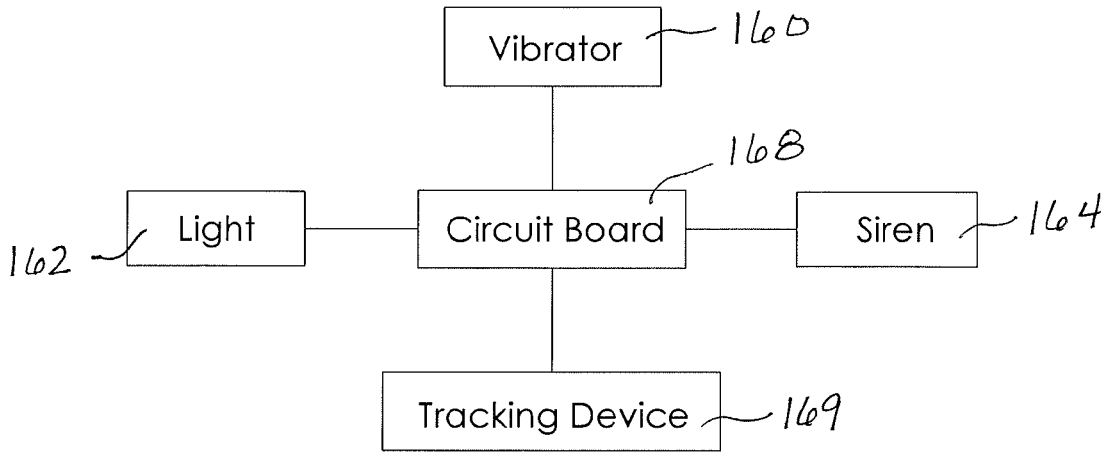
FIG. 6 is a block diagram illustrating the electronic components of the present invention.
Figure 1:
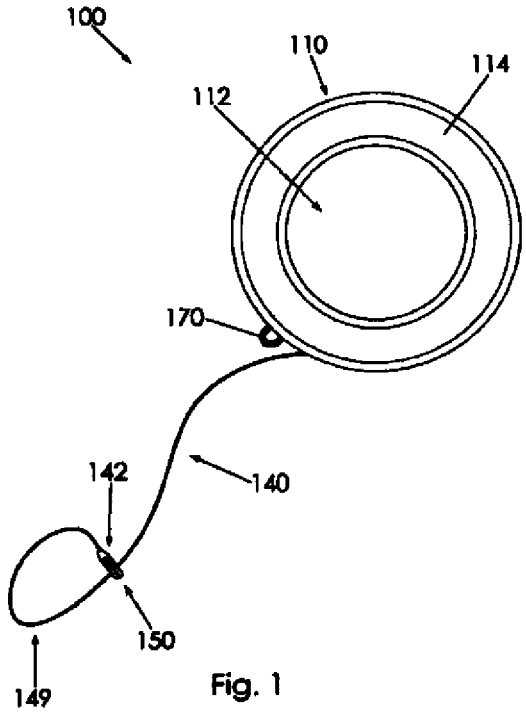
Figure 2:
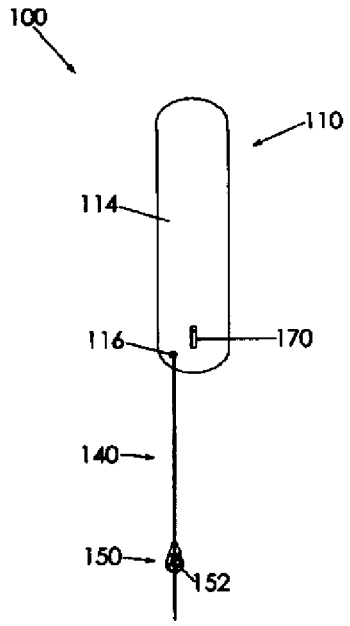
Figure 3:
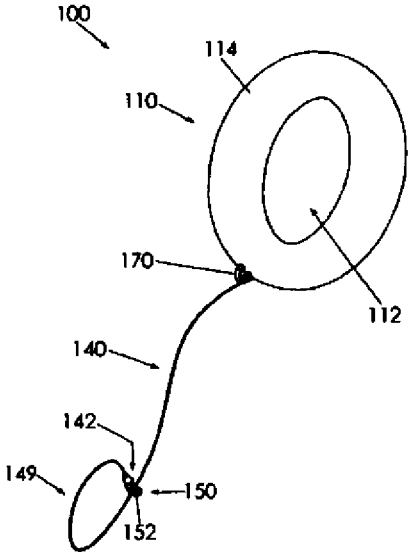
Figure 4:
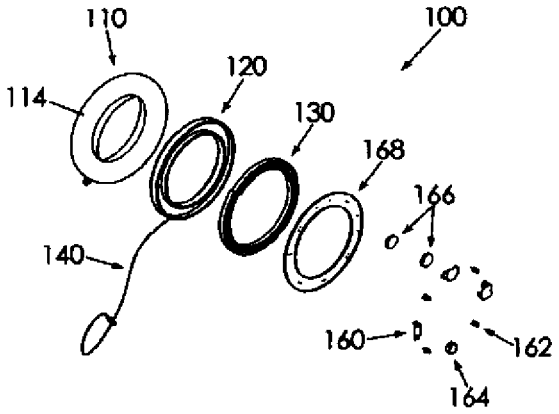
Figure 5:
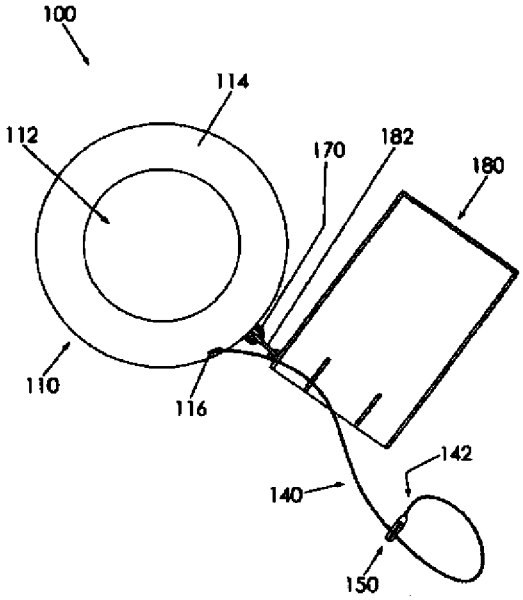
Figure 6:
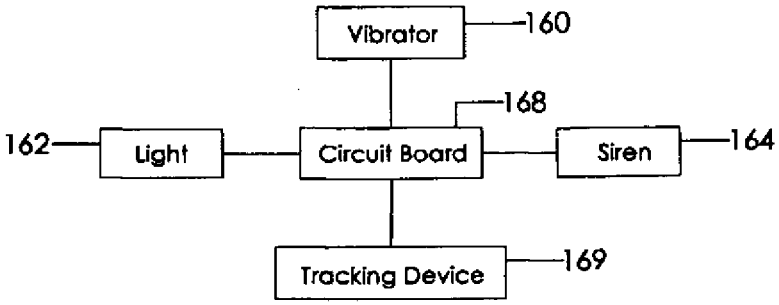

The electronic components of the present device are depicted in the block diagram of FIG. 6. In addition to those elements previously described, the personal artifact tethering device 100 may also include a tracking device 169 positioned within the casing 110 and electrically connected to the circuit board 168 and thereby to the other electrical components. The tracking device 169 may include a transmitter (not shown) programmed to send an emergency signal at predetermined time intervals or a GPS unit (not shown) and transmitter combination programmed to transmit physical location data at predetermined time intervals.

Figure 5:
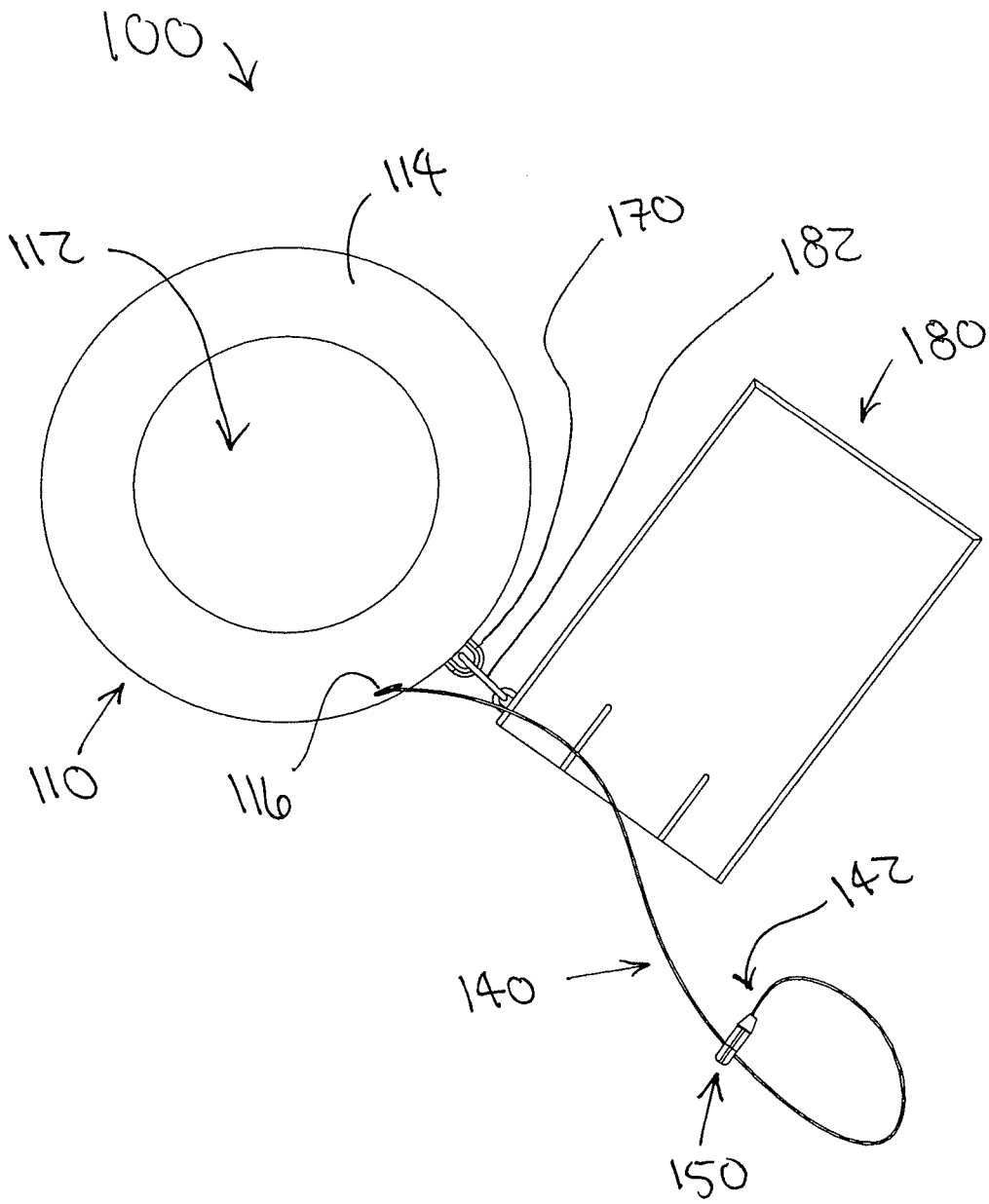
FIG. 5 is a side view of the tethering device with a wallet coupled to the casing according to the present invention.

As shown in FIG. 5, a clasp 170 may be coupled to the casing 110, and a wallet 180 may be included. The wallet 180 includes a clip 182 and may include a pocket for holding identification cards and/or other items. The clip 182 may be complementary to the clasp 170 for removably coupling the wallet 180 to the clasp 170. The wallet may be partially or completely transparent so that identification cards may be viewed without having to be removed from the wallet pocket.

In use, the casing 110 may be worn about a user's wrist by passing the user's hand through the open wrist-receiving area 112. If desired, the wallet 180 may be coupled to the casing 110 by attaching the clip 182 to the clasp 170. The hook 150 may be coupled to an item (e.g., a purse, laptop case, brief case, or another personal artifact), or if the hook 150 may not be directly coupled to the item, the hook 150 may be coupled to the tether 140 such that the closed loop 149 (FIG. 3) is formed with the article inside the closed loop 149. If the tether 140 is severed, the wiring inside the tether 140 would also be severed, causing a breach in the closed electrical loop. The circuitry may detect any breach of the closed electrical loop, and circuitry may actuate the vibrating element 160, the light 162, and/or the siren 164 upon detection of a breach of the closed electrical loop. If the tethering device 100 becomes severed or otherwise removed from a user's wrist, the tracking device 169 therein may be automatically activated such that an emergency signal is transmitted into the air and, if configured appropriately, such that a GPS location signal is automatically transmitted into the air for receipt by an appropriately configured receiving unit (not shown) or emergency network operator.

It is understood that while certain forms of this invention have been illustrated and described, it is not limited thereto except insofar as such limitations are included in the following claims and allowable functional equivalents thereof.

The invention claimed is:

1. A personal artifact tethering device, comprising:

a casing having an annular configuration with an open wrist-receiving area for allowing said casing to be worn as a bracelet on a person's wrist, said casing having an enclosed interior area;

a reel inside said enclosed interior area of said casing, said reel being movable between retracted and extended configurations;

a spring in communication with said reel and said casing to bias said reel to said retracted configuration;

a hook;

a flexible tether having a first end coupled to said reel and a second end coupled to said hook, said tether passing through said enclosed interior area of said casing such that at least a portion of said hook is always outside said enclosed interior area of said casing, relatively more of said flexible tether being outside said enclosed interior area of said casing when said reel is at said extended configuration, relatively less of said flexible tether being outside said enclosed interior area of said casing when said reel is at said retracted configuration;

a circuit board positioned inside said enclosed interior area of said casing having wiring extending from said circuit board through said tether to create a closed loop;

a tracking device positioned in said enclosed interior area of said casing and electrically connected to said circuit board, said tracking device including a global positioning system ("GPS") and a transmitter configured to send physical location data upon detection of a severing of said tether;

means for detecting said severing of said tether;

a vibrating element operatively coupled to said casing; and means for actuating said vibrating element upon detection of said severing of said tether.

2. The device of claim 1, wherein said hook has an inner area complementary to said tether and configured to allow said tether to selectively pass through said inner area to form a loop consisting of a portion of said tether and said hook.

3. The device of claim 2, further comprising:

a light operatively coupled to said casing; and means for actuating said light upon detection of said severing of said tether.

4. The device of claim 3, further comprising:

a siren operatively coupled to said casing; and means for actuating said siren upon detection of said severing of said tether.

5. The device of claim 4, further comprising at least one battery for powering said vibrating element, said light, said siren, and said tracking device.

6. The device of claim 5, further comprising:

a clasp coupled to said casing; and a wallet having a clip, said clip being complementary to said clasp for removably coupling said wallet to said clasp.

7. The device of claim 2, further comprising:

a siren operatively coupled to said casing; and circuitry for actuating said siren upon detection of said severing of said tether.

8. The device of claim 1, further comprising:

a light operatively coupled to said casing; and circuitry for actuating said light upon detection of said severing of said tether.

9. The device of claim 1, further comprising:

a clasp coupled to said casing; and a wallet having a clip, said clip being complementary to said clasp for removably coupling said wallet to said clasp.

10. A personal artifact tethering device, comprising:

a casing having an annular configuration with an open wrist-receiving area for allowing said casing to be worn as a bracelet on a person's wrist, said casing having an enclosed interior area;

a reel inside said enclosed interior area of said casing, said reel being movable between retracted and extended configurations;

a spring in communication with said reel and said casing that is configured to bias said reel to said retracted configuration;

a hook;

a flexible tether having a first end coupled to said reel and a second end coupled to said hook, said tether passing through said enclosed interior area of said casing such that at least a portion of said hook is always outside said enclosed interior area of said casing, relatively more of said flexible tether being outside said enclosed interior area of said casing when said reel is at said extended configuration, relatively less of said flexible tether being outside said enclosed interior area of said casing when said reel is at said retracted configuration;

wherein said hook has an inner area complementary to said tether, allowing said tether to selectively pass through said inner area to form a loop consisting of a portion of said tether and said hook;

a circuit board positioned inside said enclosed interior area of said casing;

wiring extending from said circuit board through said tether to create a closed loop;

a siren operatively coupled to said casing;

circuitry configured to actuate said siren upon detection of a breach of said closed loop;

a vibrating element operatively coupled to said casing;

circuitry configured to actuate said vibrating element upon detection of a breach of said closed loop;

a light operatively coupled to said casing;

circuitry configured to actuate said light upon detection of a breach of said closed loop;

a clasp coupled to said casing;

a wallet having a clip, said clip being complementary to said clasp for removably coupling said wallet to said clasp; and a tracking device positioned in said interior area of said casing and electrically connected to said circuit board, said tracking device including a global positioning system ("GPS") and a transmitter configured to transmit physical location data upon detection of a breach of said closed loop.

* * * * *

UNITED STATES PATENT AND TRADEMARK OFFICE

CERTIFICATE OF CORRECTION

PATENT NO. : 8,334,772 B2
APPLICATION NO. : 12/640247
DATED : December 18, 2012
INVENTOR(S) : Ellen B. Triggiani It is certified that error appears in the above-identified patent and that said Letters Patent is hereby corrected as shown below:

On the title page, replace the informal drawing of Fig. 5 with the formal drawing of Fig. 5 as shown on attached page.

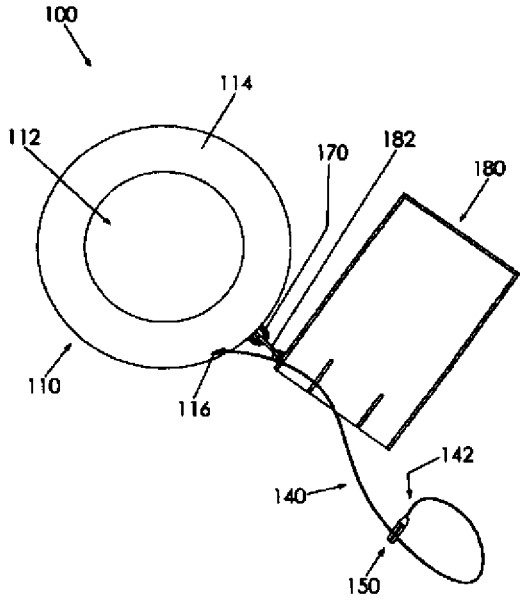

Signed and Sealed this
Twenty-sixth Day of February, 2013

Teresa Stanek Rea
*Acting Director of the United States Patent and Trademark Office*

On drawing Sheet 1 of 6, replace the informal drawing of Fig. 1 with the formal drawing of Fig. 1.

Figure 2:
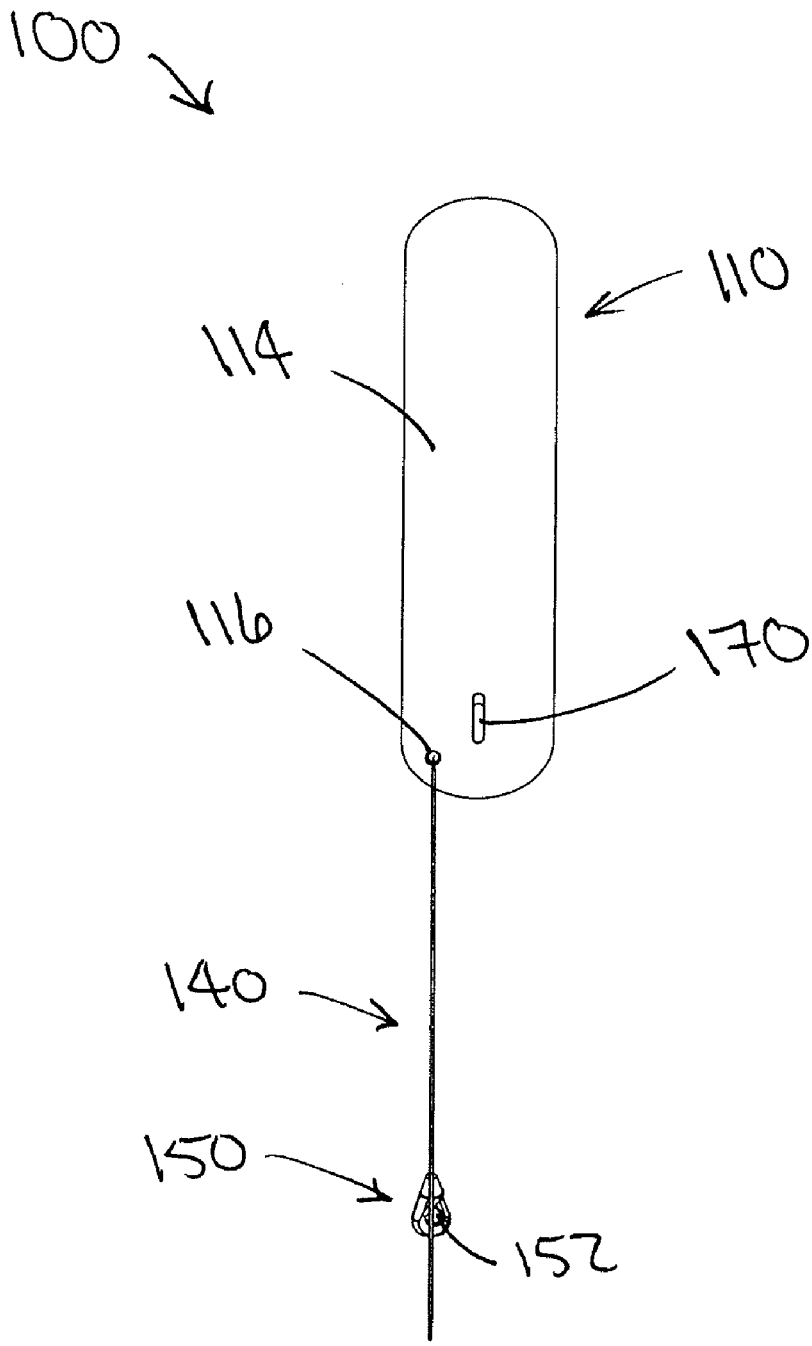
FIG. 2 is a front end view of the tethering device as in FIG. 1.

On drawing Sheet 2 of 6, replace the informal drawing of Fig. 2 with the formal drawing of Fig. 2.

Figure 3:
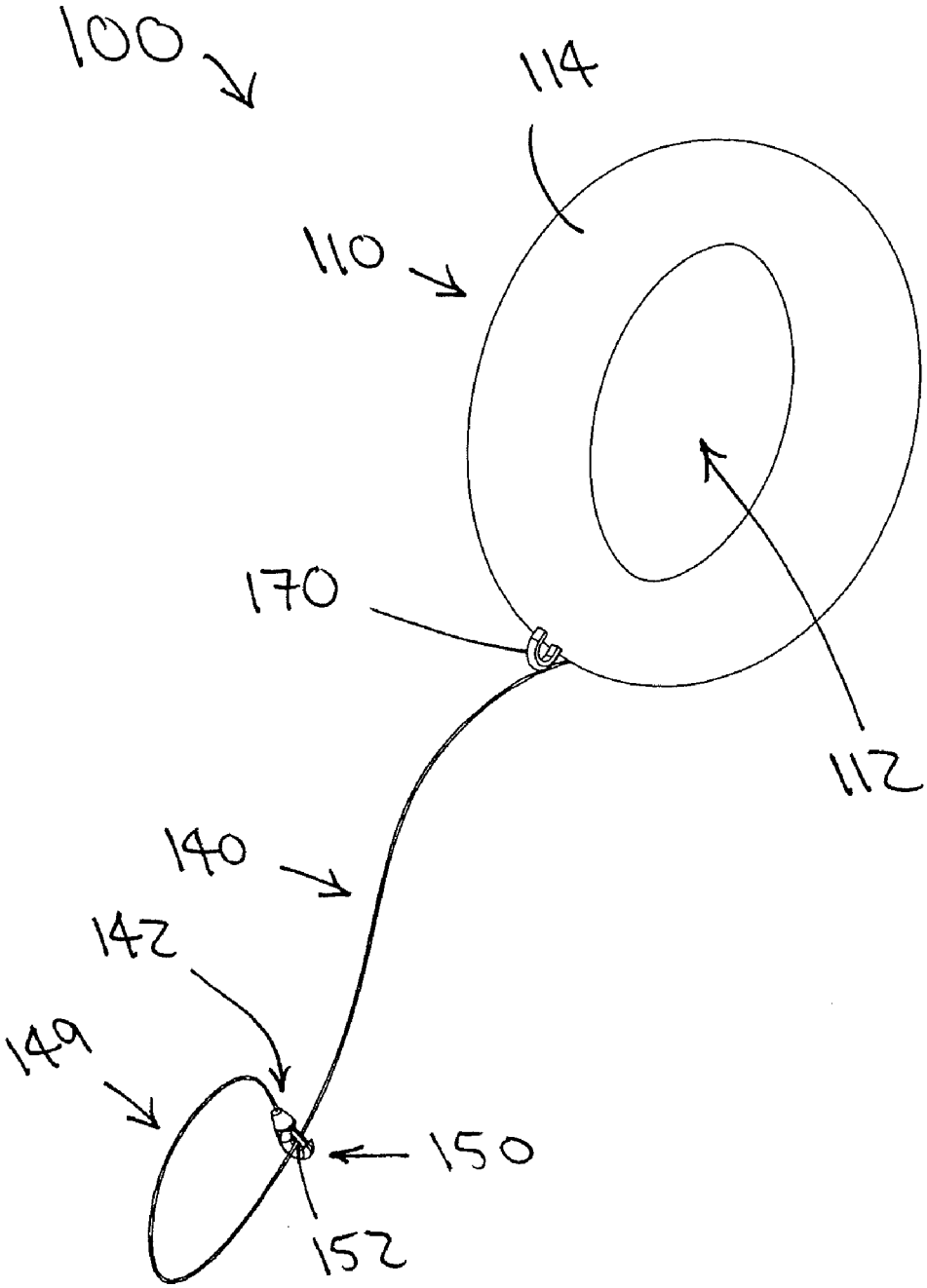
FIG. 3 is a perspective view of the tethering device as in FIG. 1.

On drawing Sheet 3 of 6, replace the informal drawing of Fig. 3 with the formal drawing of Fig. 3.

On drawing Sheet 4 of 6, replace the informal drawing of Fig. 4 with the formal drawing of Fig. 4.

On drawing Sheet 5 of 6, replace the informal drawing of Fig. 5 with the formal drawing of Fig. 5.

On drawing Sheet 6 of 6, replace the informal drawing of Fig. 6 with the formal drawing of Fig. 6.

(12) United States Patent
Triggiani

(10) Patent No.: US 8,334,772 B2
(45) Date of Patent: Dec. 18, 2012

(54) PERSONAL ARTIFACT TETHERING DEVICE

(76) Inventor: Ellen B. Triggiani, Naples, FL (US)

( * ) Notice: Subject to any disclaimer, the term of this patent is extended or adjusted under 35 U.S.C. 154(b) by 440 days.

(21) Appl. No.: 12/640,247

(22) Filed: Dec. 17, 2009

(65) Prior Publication Data

US 2011/0146857 A1 Jun. 23, 2011

(51) Int. Cl.
*G08B 13/14* (2006.01)

(52) U.S. Cl. ..... 340/568.1; 340/568.7; 340/815.4; 340/693.5

(58) Field of Classification Search ..... None
See application file for complete search history.

(56) References Cited

U.S. PATENT DOCUMENTS

| | | | | |
|---|---|---|---|---|
| 3,815,118 | A | 6/1974 | McDonald | |
| 3,851,326 | A | 11/1974 | Costa | |
| 4,080,595 | A | 3/1978 | Rosen | |
| 6,140,923 | A | 10/2000 | Lam | |
| 7,217,191 | B2 * | 5/2007 | Cordell | 463/37 |
| 2001/0038330 | A1 * | 11/2001 | Garcia | 340/568.1 |
| 2007/0158158 | A1 * | 7/2007 | Ameche | 190/108 |
| 2008/0072844 | A1 * | 3/2008 | Konigsberg | 119/770 |
| 2011/0199210 | A1 * | 8/2011 | McLean | 340/568.1 |

* cited by examiner

*Primary Examiner* — Jennifer Mehmood
*Assistant Examiner* — Brian Wilson
(74) *Attorney, Agent, or Firm* — Dale J. Ream

(57) ABSTRACT

A personal artifact tethering device includes a casing having an open wrist-receiving area for allowing the casing to be worn as a bracelet on a person's wrist, the casing having an enclosed interior area. A reel is positioned inside the enclosed interior area and is movable between retracted and extended configurations. A spring connects the spring and casing and biases the reel to the retracted configuration. The tethering device includes a flexible tether having a first end coupled to the reel and a second end coupled to a hook, the tether passing through the enclosed interior area of the casing such that at least a portion of the hook is always outside the enclosed interior area, relatively less of the flexible tether being outside the enclosed interior area of the casing when the reel is at the retracted configuration.

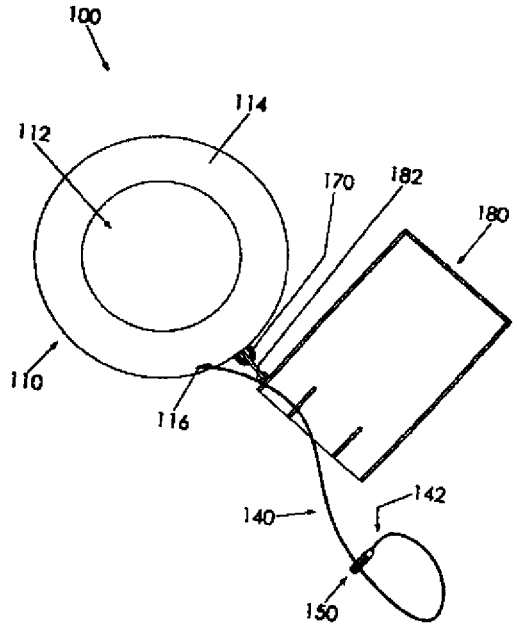

10 Claims, 6 Drawing Sheets